US006629787B2

(12) United States Patent
Lee et al.

(10) Patent No.: US 6,629,787 B2
(45) Date of Patent: Oct. 7, 2003

(54) APPARATUS AND METHOD FOR ADJUSTING A HEAD GAP OF AN INKJET PRINTER

(75) Inventors: Seung-Jae Lee, Suwon (KR); Se-Woong Ahn, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/899,292

(22) Filed: Jul. 6, 2001

(65) Prior Publication Data

US 2002/0098025 A1 Jul. 25, 2002

(30) Foreign Application Priority Data

Jan. 20, 2001 (KR) ..... 2001-3369

(51) Int. Cl.[7] ..... B41J 25/304

(52) U.S. Cl. ..... 400/59; 400/56; 400/711; 347/8

(58) Field of Search ..... 347/8; 400/56, 400/57, 59, 55, 703, 711

(56) References Cited

U.S. PATENT DOCUMENTS 4,178,106 A * 12/1979 Mailer et al. ..... 400/57
4,420,269 A * 12/1983 Ackermann et al. ..... 400/320
4,676,675 A * 6/1987 Suzuki et al. ..... 338/114
4,917,512 A * 4/1990 Mimura et al. ..... 226/45
5,156,466 A * 10/1992 Inagaki et al. ..... 400/355
5,257,867 A * 11/1993 Ito et al. ..... 400/56
5,316,395 A * 5/1994 Imai ..... 400/56
5,678,936 A * 10/1997 Hino ..... 347/8
5,772,339 A * 6/1998 Yamaguchi ..... 400/55
6,059,468 A * 5/2000 Haug ..... 347/197
6,076,909 A * 6/2000 Saeki et al. ..... 347/8
6,315,468 B2 * 11/2001 Kishida et al. ..... 347/19

* cited by examiner

*Primary Examiner*—Andrew H. Hirshfeld
*Assistant Examiner*—Dave Ghatt
(74) *Attorney, Agent, or Firm*—Robert E. Bushnell, Esq.

(57) ABSTRACT

An apparatus for adjusting a head gap of an inkjet printer includes: a main frame; an eccentric shaft rotatably disposed on the main frame, and including an eccentric supporting shaft; a head assembly movably disposed on the eccentric shaft, and including a print head for supplying ink onto a printing medium for printing on the printing medium; a head gap detecting sensor for detecting the head gap defined between the printing medium and the print head; an eccentric shaft turning means for automatically adjusting the head gap by turning the eccentric shaft by a predetermined angle; and a controller for controlling the driving of the eccentric shaft turning means so as to compensate for the head gap detected by the head gap detecting sensor to provide a predetermined head gap corresponding to the printing medium.

18 Claims, 7 Drawing Sheets

APPARATUS AND METHOD FOR ADJUSTING A HEAD GAP OF AN INKJET PRINTER

CLAIM OF PRIORITY

This application makes reference to, incorporates the same herein, and claims all benefits accruing under 35 U.S.C. §119 from my application APPARATUS FOR ADJUSTING HEAD-GAP OF INK-JET PRINTER filed with the Korean Industrial Property Office on Jan. 20, 2001 and there duly assigned Serial No. 3369/2001.

BACKGROUND OF THE INVENTION

1. Field of the Invention

The present invention relates to an apparatus for adjusting a head gap of an ink jet printer, and, more particularly, to an apparatus for adjusting the head gap of the ink jet printer capable of automatically adjusting the head gap.

2. Description of the Related Art

Generally, an ink jet printer includes an eccentric shaft disposed in a main frame, a print head conveying bracket that is moved along the eccentric shaft, an ink cartridge disposed on the conveying bracket and having a print head, a conveying means for reciprocating the conveying bracket in a lengthwise direction of the eccentric shaft, and a head gap adjusting device for adjusting a head gap defined between the print head and a printing medium.

Based on image data input to the print head, the print head supplies ink to the printing medium and thereby forms an image on the printing medium. The conveying means includes a conveying belt disposed on the main frame for circulating in the lengthwise direction of the eccentric shaft, and includes a motor for circulating the conveying belt. The conveying belt is connected to the conveying bracket. Accordingly, the conveying bracket is moved together with the conveying belt that is circulated by the driving force of the motor.

The head gap adjusting device adjusts the head gap according to the thickness of the printing medium being supplied to the ink jet printer. The head gap adjusting device includes a bushing member rotatably disposed on the main frame, and a lever for turning the bushing member. The eccentric shaft is turned together with the bushing member. Accordingly, the height of the eccentric shaft is varied according to the position of the lever and, thus, the head gap is adjusted. For example, when the printing medium being supplied is a relatively thick material, such as an envelope, a user adjusts the head gap by turning the lever in a direction which will raise the eccentric shaft. When the printing medium being supplied is a relatively thinner material, such as an A4 sheet, the user adjusts the head gap by turning the lever in a direction which will lower the eccentric shaft.

According to the conventional apparatus for adjusting the head gap as described above there is, however, an inconvenience in that the user has to manually adjust the head gap. That is, the user has to manually turn the lever typically according to guesswork about the material and thickness of the printing medium.

Further, according to the above-described structure of an ink jet printer, the head gap typically cannot be variably adjusted. That is, the head gap adjusting device or apparatus is typically constructed to accommodate a limited type of printing medium, such as A4 sheet and envelope, or the like. Accordingly, the conventional head gap adjusting device apparatus typically cannot adjust the head gap efficiently according to printing mediums of different thickness.

SUMMARY OF THE INVENTION

The present invention has been made to overcome the above-mentioned problem of the related art, and accordingly, it is an object, among other objects, of the present invention to provide an apparatus for adjusting a head gap of an inkjet printer having an improved structure for automatically adjusting the head gap according to various types of the printing medium being supplied to the ink jet printer.

The above object, among other objects, of the present invention is accomplished by an apparatus for adjusting a head gap of an inkjet printer according to a first aspect of the present invention, the apparatus including: a main frame; an eccentric shaft including an eccentric supporting shaft at each end of the eccentric shaft, the eccentric shaft being rotatably disposed on the main frame by each eccentric supporting shaft; a head assembly movably disposed on the eccentric shaft, the head assembly including a print head for supplying an ink onto a printing medium for printing; a head gap detecting sensor for detecting the head gap defined between the printing medium and the print head; an eccentric shaft turning means for automatically adjusting the head gap by turning the eccentric shaft to move the eccentric shaft through a predetermined angle to move the head assembly to provide a predetermined head gap; and a controller for controlling the driving of the eccentric shaft turning means so as to move the eccentric shaft through the predetermined angle to compensate for the head gap detected by the head gap detecting sensor to provide the predetermined head gap.

The eccentric shaft turning means includes: a gear disposed on the eccentric supporting shaft; and a motor connected to the gear, the motor being driven under the control of the controller for rotating the gear in a predetermined direction by a predetermined angle.

The above object, among other objects, of the present invention is also accomplished by an apparatus for adjusting a head gap of an inkjet printer according to another or a second aspect of the present invention, the apparatus including: a main frame; a head assembly including a print head; an eccentric shaft for movably supporting the head assembly, the eccentric shaft including a supporting shaft at each end of the eccentric shaft, each supporting shaft being rotatably supported on the main frame; a turning means for adjusting the head gap between the print head and the printing medium by selectively turning the eccentric shaft forward in a first direction and backward in a second direction opposite to the first direction by a predetermined angle. The turning means includes a pivot lever or pivot member formed or displayed on the supporting shaft for pivotal movement together with a rotatable movement of the supporting shaft; a movable member movably disposed on or with respect to the main frame for reciprocating movement on or with respect to the main frame, the movable member for providing the pivotal movement or the pivot lever by a reciprocating movement of the movable member; a driving portion or driving means for providing the reciprocating movement of the movable member; and a controller for controlling the driving of the driving means or driving portion.

The movable member and the pivot lever each include a slant surface of a predetermined sloping degree, respectively, with the slant surface of the movable member being disposed in facing, opposing relation to the slant surface of the pivot member, and with the slant surface of the movable member and the slant surface of the pivot member each respectively moving in opposite directions during pivotal movement of the pivot member.

The slant surface of the movable member and the slant surface of the pivot member each includes a projection formed on the respective slant surface, for limiting a range of movement of the movable member and the pivot member and for preventing the movable member from being separated from contact with the pivot member.

The driving portion or driving means includes: a rack gear formed on a side of the movable member; a pinion gear rotatably formed on the main frame and for meshed engagement with the rack gear; and a motor for driving the pinion gear to provide the reciprocating movement of the movable member.

The eccentric shaft includes: a shaft body on which the head assembly is movably disposed; and bushing members on which both ends of the shaft body are eccentrically supported, with the bushing members being rotatably disposed on the main frame, the pivot lever or pivot member being incorporated with at least one bushing member.

Further, in the second aspect of an apparatus according to the present invention, there is provided a head gap detecting sensor disposed on the head assembly for detecting data corresponding to the head gap between a printing medium and the print head, and providing the detected data to the controller so that the controller can control the driving of the driving portion or driving means based on the detected data.

Further, in the second aspect of an apparatus according to the present invention, there is also provided a spring or spring member for elastically biasing the pivot lever or pivot member so as to a contact or position the pivot member in an engaging relation with the movable member.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, and wherein.

DETAILED DESCRIPTION OF THE PREFERRED EMBODIMENTS

This invention will be described in further detail by way of example with reference to the attached drawings of FIGS. 1 through 9, particularly FIGS. 3 through 9.

Figure 1:
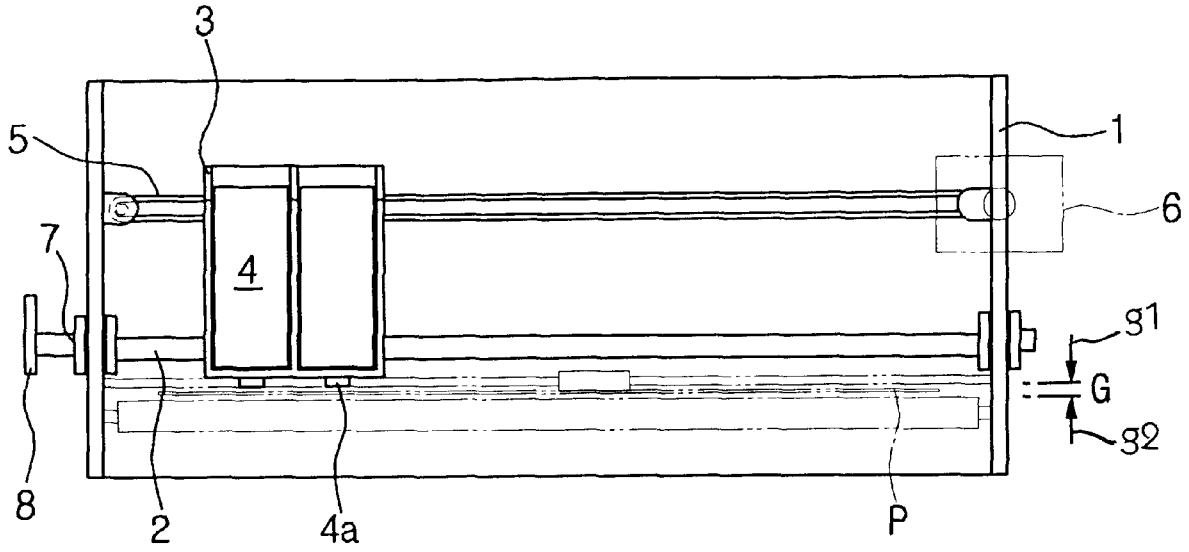
FIG. 1 is a schematic view illustrating a conventional head gap adjusting apparatus of an inkjet printer.

Generally, as shown in FIG. 1, an ink jet printer includes an eccentric shaft 2 disposed in a main frame 1, a head conveying bracket 3 moved along the eccentric shaft 2, an ink cartridge 4 disposed on the conveying bracket 3 and having a print head 4*a*, a conveying means for reciprocating the conveying bracket 3 in a lengthwise direction of the eccentric shaft 2, and a head gap adjusting device 7, 8 for adjusting a head gap G indicating the arrows g1 and g2 defined between the print head 4*a* and a printing medium P.

Based on image data input to the print head, the print head 4*a* supplies ink to the printing medium P and thereby forms an image on the printing medium P. The conveying means includes a conveying belt 5 disposed on the main frame 1 for circulating in the lengthwise direction of the eccentric shaft 2, and a motor 6 for circulating the conveying belt 5. The conveying belt 5 is connected to the conveying bracket 3. Accordingly, the conveying bracket 3 is moved together with the conveying belt 5 that is circulated by the driving force of the motor 6.

Figure 2A:
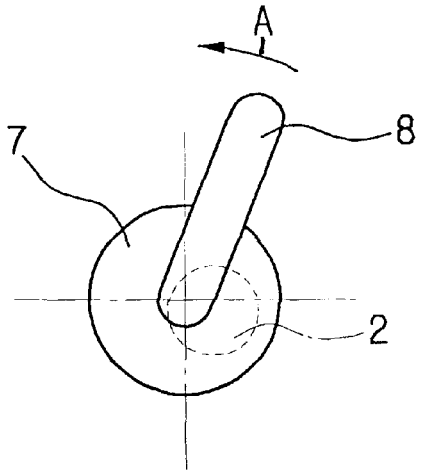
FIGS. 2A and 2B are views for explaining and illustrating the operation of a bushing member of FIG. 1, respectively.
Figure 2B:
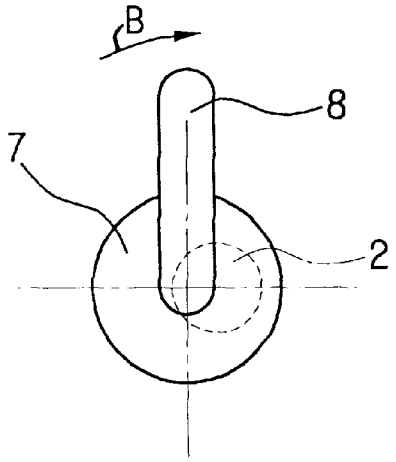

Referring to FIGS. 1 through 2B, the head gap adjusting device 7, 8 adjusts the head gap G according to the thickness of the printing medium P being supplied to the ink jet printer. The head gap adjusting device 7, 8 includes a bushing member 7 rotatably disposed on the main frame 1, and a lever 8 for turning the bushing member 7. Referring to FIG. 2A, the eccentric shaft 2 is turned together with the bushing member 7. Accordingly, as shown in FIGS. 2A and 2B, the height of the eccentric shaft 2 is varied according to the position of the lever 8 and, thus, the head gap G is adjusted. For example, when the printing medium P being supplied is a relatively thick material, such as an envelope, a user adjusts the head gap G by turning the lever 8 in a direction indicated by the arrow A, in FIG. 2A, which will raise the eccentric shaft 2 to a state shown in FIG. 2B. When the printing medium P being supplied is a relatively thinner material, such as an A4 sheet of paper, the user adjusts the head gap G by turning the lever 8 in a direction indicated by the arrow B in FIG. 2B, which will lower the eccentric shaft 2 to a state such as shown in FIG. 2A.

Figure 3:
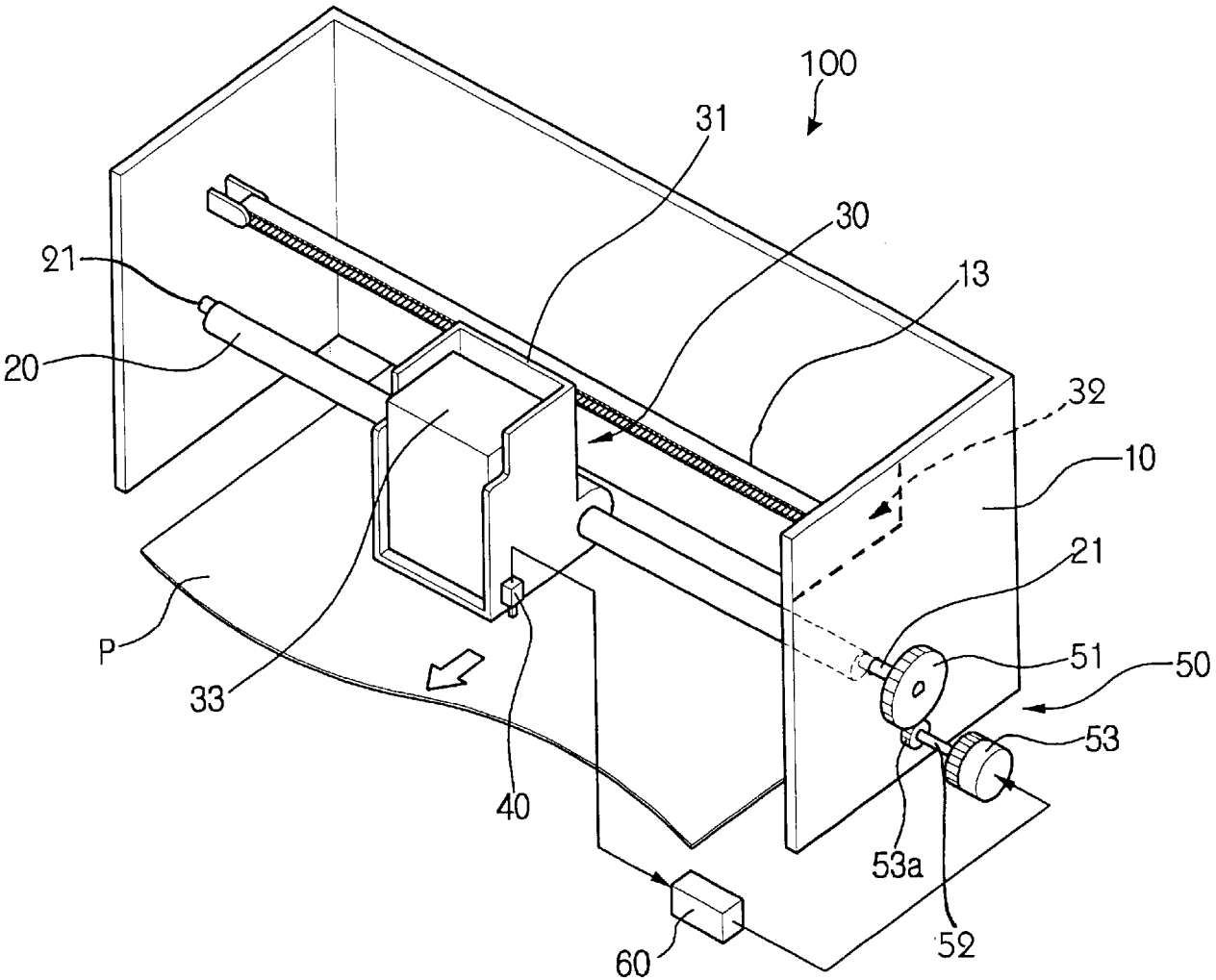
FIG. 3 is a schematic perspective view illustrating a head gap adjusting apparatus of an inkjet printer according to one preferred embodiment of the present invention.
Figure 4:
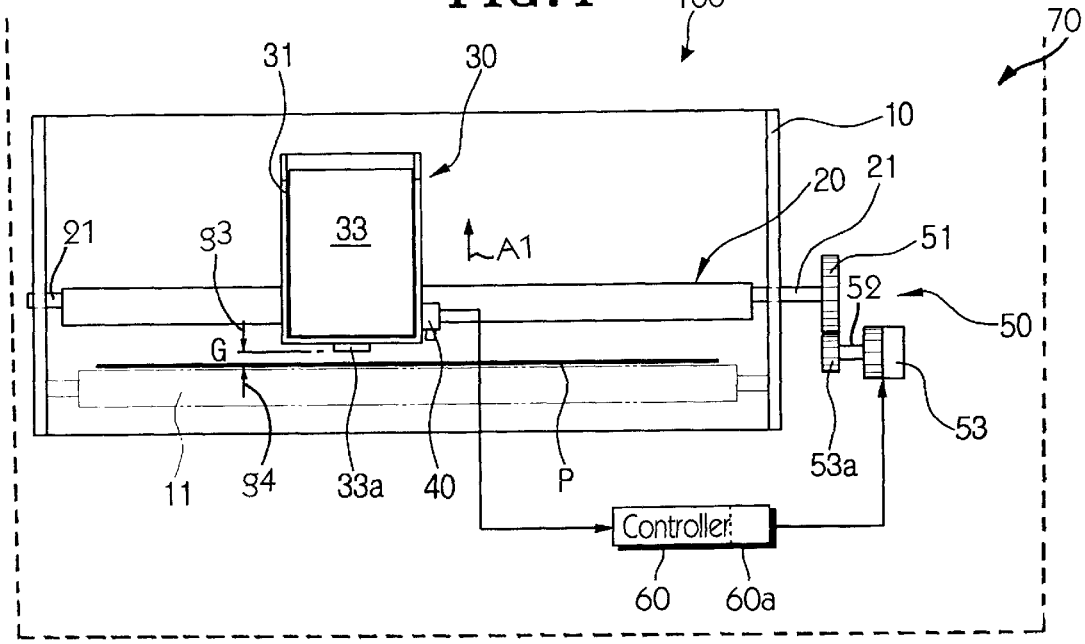
FIG. 4 is a front view illustrating the head gap adjusting apparatus of FIG. 3.
Figure 5:
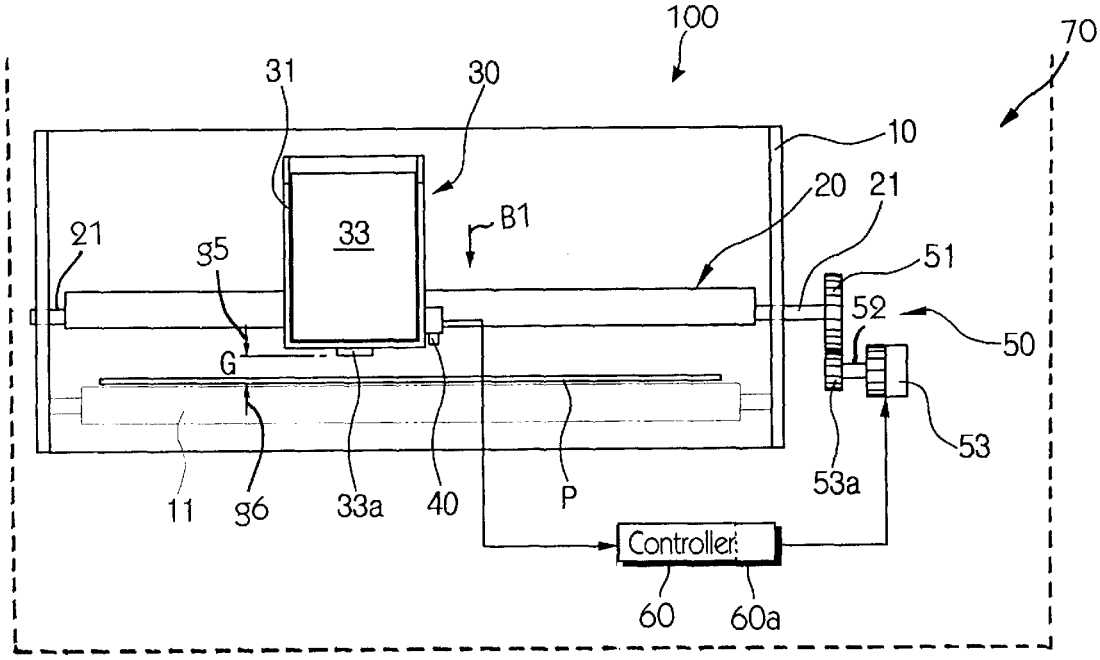
FIG. 5 is a front view illustrating a head assembly of FIG. 4 of the head gap adjusting apparatus of FIG. 3 being in a raised position.

Referring now to FIGS. 3 through 5, a head gap adjusting apparatus 100 of an inkjet printer according to a preferred embodiment of the present invention is illustrated. The head gap adjusting apparatus 100 includes a main frame 10, an eccentric shaft 20 rotatably disposed in the main frame 10, a head assembly 30 movably supported on the eccentric shaft 20, a head gap detecting sensor 40 formed on the head assembly 30 for being moved together with the head assembly 30, a turning means 50 for turning the eccentric shaft 20, and a controller 60. The eccentric shaft 20 includes a pair of supporting shafts 21 each being respectively formed on both ends of the eccentric shaft 20. The supporting shafts 21 are rotatably supported in the main frame 10.

Continuing with reference to FIGS. 3 through 5, the head assembly 30 includes a conveying bracket 31 and an ink cartridge 33. The conveying bracket 31 is movably disposed on the eccentric shaft 20. Also, the conveying bracket 31 is reciprocated in a lengthwise direction of the eccentric shaft 20 by a conveying means that includes a conveying belt 13. The conveying belt 13, supporting the conveying bracket 31, is moved by a carrier motor 32. The ink cartridge 33 is removably mounted on the conveying bracket 31. On a lower end of the ink cartridge 33, a print head 33*a* is formed to supply ink to the printing medium P that is fed by a feeding roller 11. A head gap G is defined between the print head 33*a* and the printing medium P.

The head gap detecting sensor 40 is moved together with the conveying bracket 31, although the head gap detecting sensor 40 can be otherwise appropriately located in the ink jet printer. The head gap detecting sensor 40 measures a distance, that is the head gap G between the printing medium P and the print head 33*a*, and sends measurement data relating to the measured distance corresponding to the head gap G to the controller 60, controller 60 being a central processing unit or a microprocessor, for example. The head gap detecting sensor 40 can be a light receiving and emitting sensor, for example, for measuring the head gap G.

As illustrated in FIGS. 3 through 5, the turning means 50 of the head gap adjusting apparatus 100 includes a gear 51 formed on one end of the supporting shaft 21, and a motor 53 for driving the gear 51. A shaft gear 53*a* formed on a shaft 52 of the motor 53 is engaged with the gear 51. The motor 53 can be mounted on or in communication with the main frame 10, or on or in communication with a body 70 of the ink jet printer. The controller 60 controls the driving direction and the driving occurrence of the motor 53.

The operation of the head gap adjusting apparatus 100 of the inkjet printer of FIGS. 3 through 5 constructed as above according to a preferred embodiment of the present invention will now be described. First, as shown in FIG. 4, the printing medium P is fed to a lower side of the print head 33*a* by the feeding roller 11. Then, the head gap detecting sensor 40 emits light to the printing medium P, receives reflected light from the printing medium P and detects the length or distance of the head gap G. The detected data corresponding to the head gap G is sent to the controller 60. The controller 60 compares the received detected data with a predetermined reference value corresponding to a head gap G for optimum printing on the printing medium P, the predetermined reference value being stored in a memory 60*a* of controller 60 or provided to controller 60, such as through an input key or selector of the ink jet printer or from a computer. For example, when the printing medium P is thicker, such as thicker than an A4 sheet, the detected data about the length or distance of the head gap G is determined to be lower than the predetermined reference value, thereby requiring an increase of the head gap G. Accordingly, the controller 60 sends a signal to the motor 53 causing the motor 53 to rotate in a corresponding predetermined direction a corresponding predetermined number of times, so as to move the head assembly 30 in the direction indicated by the arrow A1 of FIG. 4. The rotation of the motor 53 in the predetermined direction causes the gear 51 to be driven together with the shaft gear 53*a*, turning the supporting shaft 21 through a corresponding predetermined angle corresponding to the head gap G for optimum printing on the printing medium P. At this time, since the supporting shaft 21 is eccentrically formed with respect to the eccentric shaft 20, the head assembly 30 supported on the eccentric shaft 20 is raised as shown in FIG. 5 so as to increase the distance of the head gap G, such as from that indicated by the arrows g3 and g4 in FIG. 4 to an increased distance for the head gap G, such as indicated by the arrows g5 and g6 in FIG. 5, for example. Accordingly, the head gap G between the print head 33*a* and the printing medium P is adjusted appropriately for optimum printing on the printing medium P.

However, continuing with reference to FIGS. 3 through 5, when the printing medium P being supplied to the ink jet printer is thinner, such as thinner than an envelope, such as an A4 sheet, for example the print head 33*a* typically is lowered to adjust the head gap G. Accordingly, the detected data relating to a distance of the head gap G from the head gap detecting sensor 40 is compared by the controller 60 to a predetermined reference value corresponding to a head gap G for optimum printing on the printing medium P. Accordingly, based on the comparison of the detected data with the predetermined reference value, the controller 60 controls the driving of the motor 53 causing the motor 53 to rotate in a corresponding predetermined direction a corresponding predetermined number of times, the corresponding predetermined direction to lower the head assembly 30 being opposite to the corresponding predetermined direction to raise the head assembly 30. The gear 51 is thus oppositely turned by the motor 53, the gear 51 being driven with gear shaft 53, turning the supporting shaft 21 through a corresponding predetermined angle in an opposite direction to a direction for raising the head assembly 30. Accordingly, the head assembly 30 supported on the eccentric shaft 20 is lowered by a predetermined distance in the direction of the arrow B1 in FIG. 5 so as to decrease the distance of the head gap G, such as from that indicated by the arrows g5 and g6 in FIG. 5, to a decreased distance for the head gap G, such as indicated by the arrows g3 and g4 in FIG. 4, for example.

Accordingly, the head gap G between the print head 33*a* and the printing medium P is adjusted appropriately according to the thickness of the printing medium P. As described, by using the data detected by the head gap detecting sensor 40, the controller 60 automatically adjusts the head gap G as previously described. That is, regardless of the type of the printing medium P, the controller 60 can maintain a desired length or distance of the head gap G. Further, when the controller 60 compares the data corresponding to the head gap G detected by head gap detecting sensor 40 to a predetermined reference value corresponding to a head gap G for optimum printing on the printing medium P, and the detected data corresponds to such predetermined reference value, no adjustment or no further adjustment of the head gap G is made by the controller 60. In such case, the detected data corresponding to the head gap G indicates that the distance of the head gap G detected already corresponds to a head gap G for optimum printing on the printing medium P.

Accordingly, the compatibility of the ink jet printer is increased since the ink jet printer can use various types of printing mediums P. Further, deterioration of the print quality when using different types of the printing medium P advantageously can be reduced or prevented.

Figure 6:
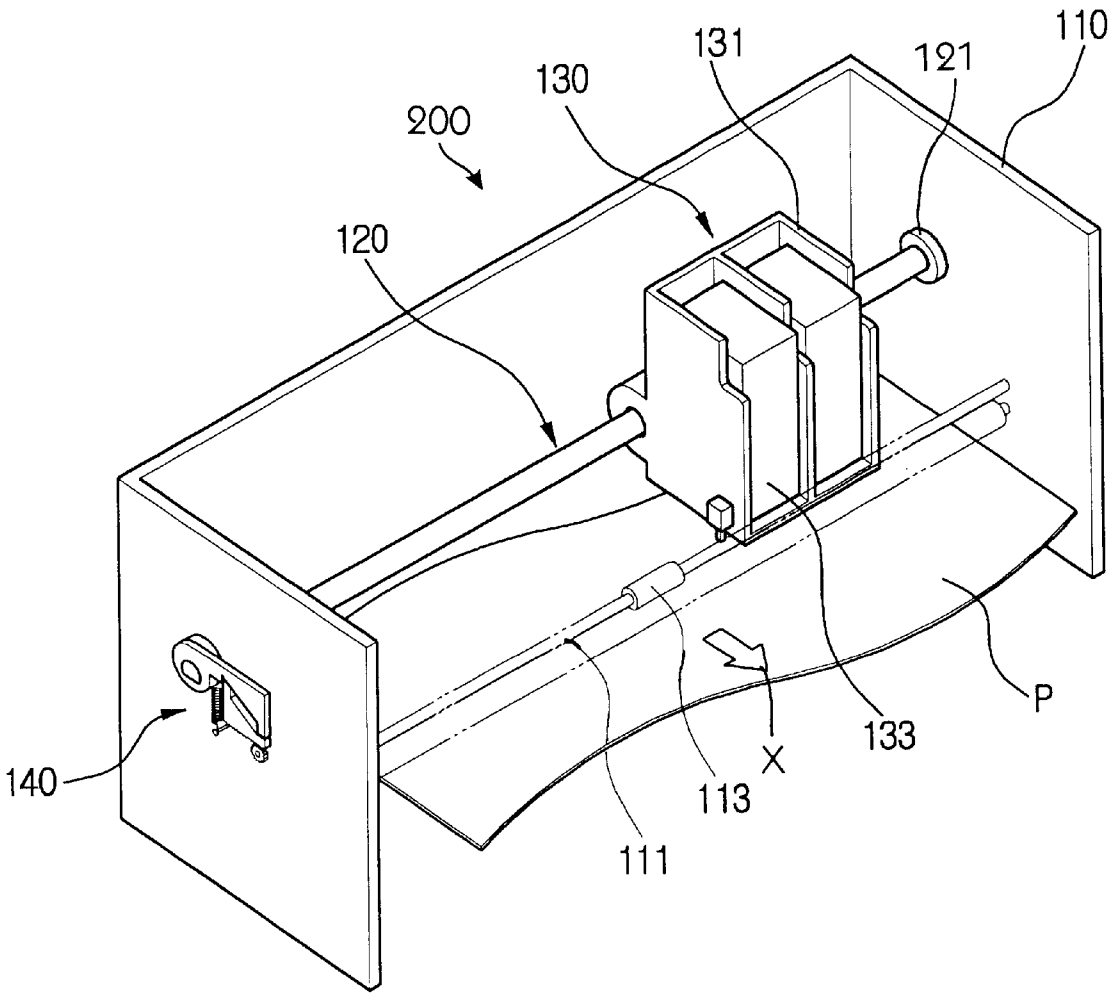
FIG. 6 is a schematic perspective view illustrating the head gap adjusting apparatus of an inkjet printer according to another preferred embodiment of the present invention.

Continuing now with reference to FIGS. 6 through 9, first referring to FIG. 6, a head gap adjusting apparatus 200 of an inkjet printer according to another preferred embodiment of the present invention is illustrated. The head gap adjusting apparatus 200 includes a main frame 110, an eccentric shaft 120 rotatably disposed on the main frame 110, a head assembly 130 movably disposed on the eccentric shaft 120, and a shaft turning means 140 for turning the eccentric shaft 120 by a predetermined angle, and returning the eccentric shaft 120 to an original position. A feeding roller 111 is disposed in the main frame 110 to feed the printing medium P, which is picked up by a pickup means for the ink jet printer, to a lower side of the head assembly 130. The feeding roller 111 is contact-rotated by a backup roller 113.

Figure 7:
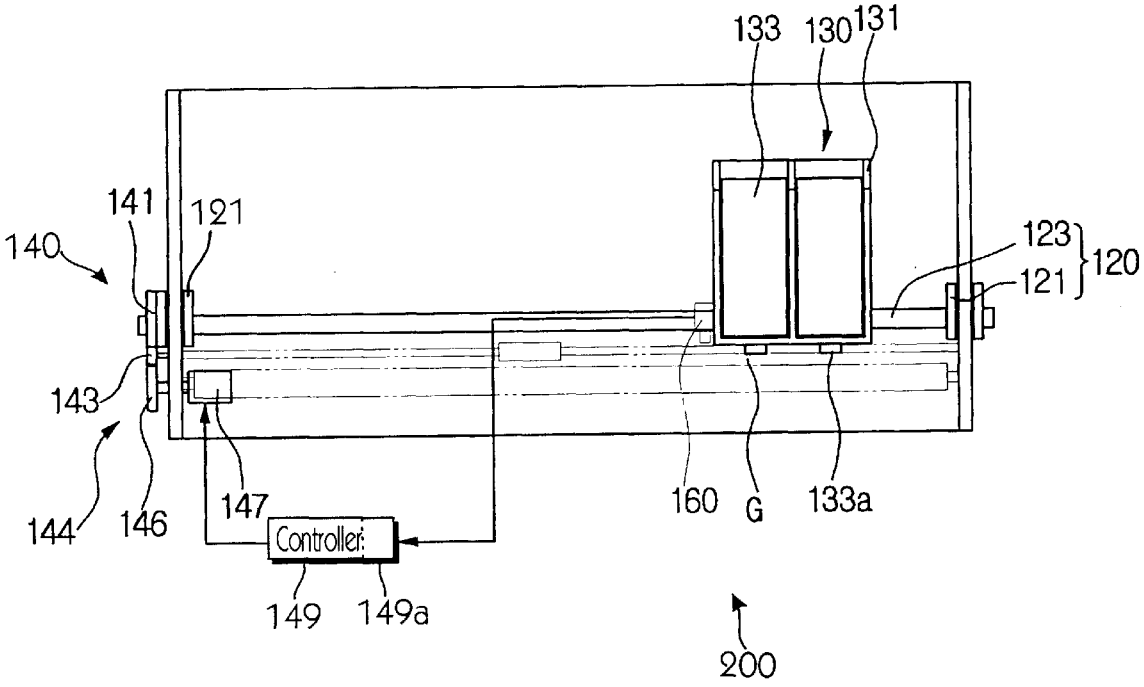
FIG. 7 is a schematic front view illustrating the head gap adjusting apparatus of FIG. 6.

Referring now to FIG. 7, the eccentric shaft 120 of the head gap adjusting apparatus 200 includes a supporting shaft 121 rotatably disposed on the main frame 110. A bushing member is an example of the supporting shaft 121. Further, the eccentric shaft 120 has a shaft body 123 that is eccentrically disposed with respect to the pivotal center of the bushing member 121. A pair of supporting shafts 121 (hereafter referred to as bushing members 121) are respectively located at opposing ends of the eccentric shaft 120 on the shaft body 123. The shaft body 123 is moved upward and downward according to the pivotal angle of each bushing member 121, during the pivotal movement of each bushing member 121.

The head assembly 130 of the head gap adjusting apparatus 200 of FIGS. 6 through 9, is movably disposed on the shaft body 123. The head assembly 130 is moved in a lengthwise direction of the shaft body 123 by a conveying means that includes a conveying belt, such as the motor 32 and the conveying belt 13 of the head gap adjusting apparatus 100 illustrated in FIG. 3. The head assembly 130 includes a conveying bracket 131 supported on the shaft body 123, and an ink cartridge 133 removably mounted on the conveying bracket 131. The ink cartridge 133 has a print head 133*a* for maintaining a proper head gap G with the printing medium P. The print head 133*a* supplies ink to the printing medium P, thereby forming a predetermined image on the printing medium P, the printing medium P moving in the direction of the arrow X in FIG. 6 for printing on the printing medium P.

Figure 8:
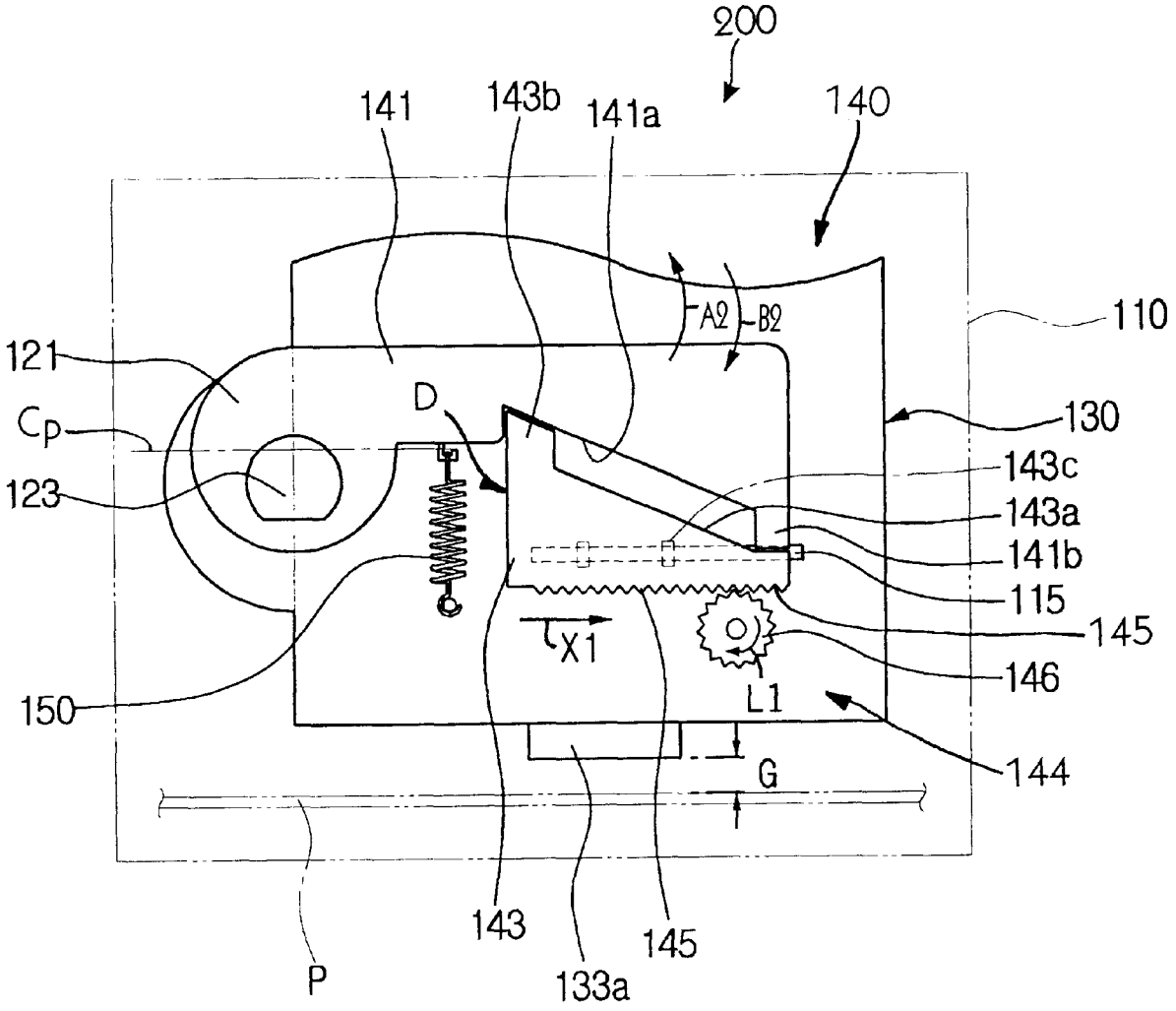
FIG. 8 is a schematic side view for illustrating and explaining the operation of the head gap adjusting apparatus of FIGS. 6 and 7.
Figure 9:
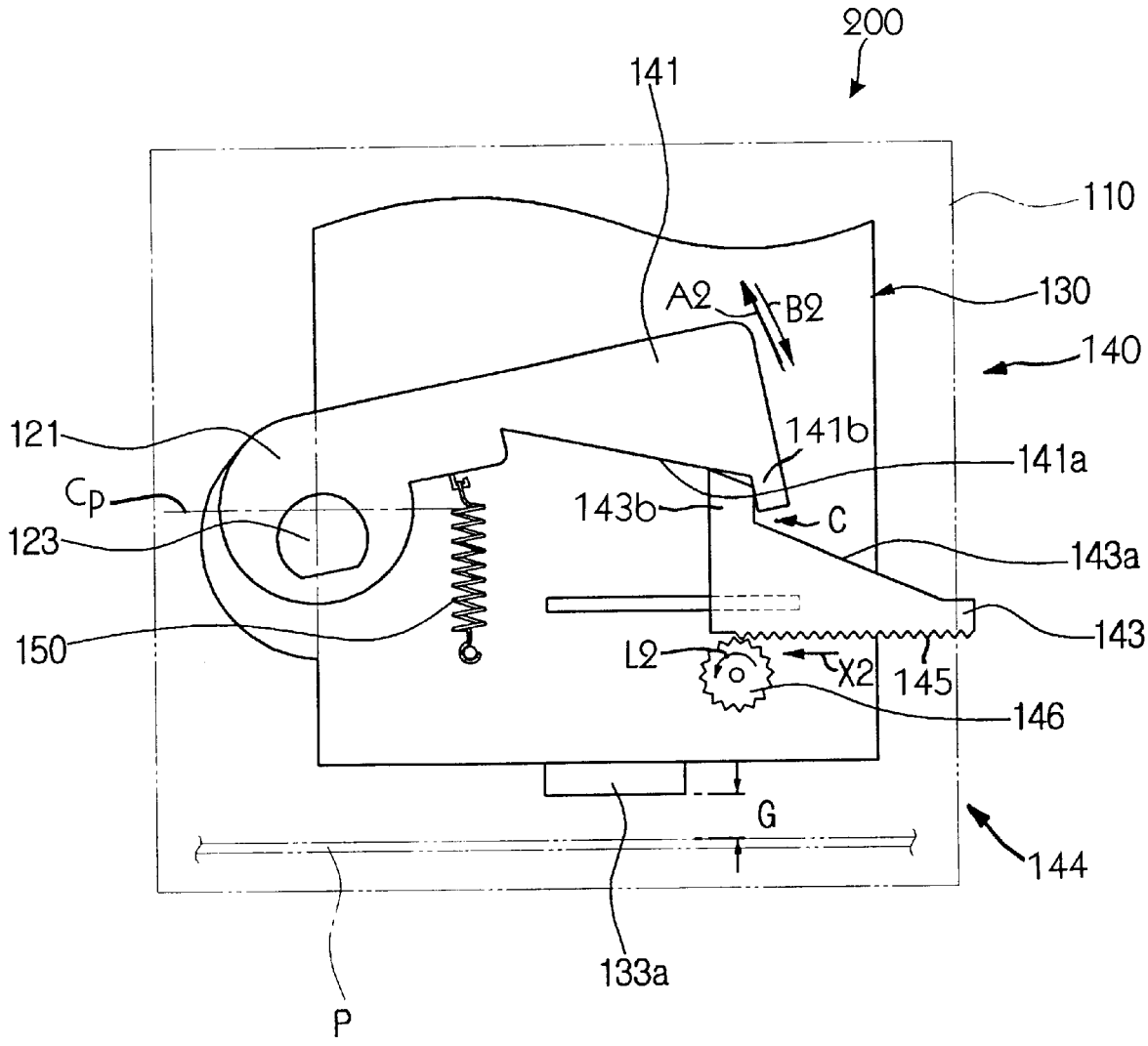
FIG. 9 is another schematic side view for illustrating and explaining the operation of the head gap adjusting apparatus of FIGS. 6 and 7.

Continuing with reference to FIGS. 6 through 9, the shaft turning means 140 selectively turns each bushing member 121 of the pair of bushing members 121 in a predetermined first direction or in a predetermined second direction opposite to the predetermined first direction, and thereby selectively raising or lowering the head assembly 130 and selectively increasing or decreasing the head gap G. As shown in FIGS. 7 through 9, the turning means 140 includes a pivot lever 141 or pivot member disposed on at least one bushing member 121 or on each bushing member 121, a movable member 143 disposed on the main frame 110 for reciprocating movement, a driving portion 144 for reciprocating the movable member 143 for the reciprocating movement, and a controller 149, the controller 149 being a central processing unit or a microprocessor, for example. The driving portion 144 includes a rack gear 145 formed on a lower end of the movable member 143, a pinion gear 146 disposed on the main frame 110 that meshes in engagement with the rack gear 145, and a motor 147 for rotating the pinion gear 146. The motor 147 is installed on the main frame 110, for example. The controller 149 controls the driving of the motor 147 to control the movement at the movable member 143.

Again referring to FIGS. 6 through 9, the pivot lever or pivot member 141 is integrally formed or incorporated with at least one or each bushing member 121. Accordingly, by turning the pivot lever 141 by a predetermined angle, each bushing member 121 is also turned. The pivot lever 141 has a slant surface 141 a slanted along a lengthwise direction of the pivot lever 141 at a predetermined slant angle of a predetermined sloping degree, and a projection 141*b* protruding from the slant surface 141*a*. In this embodiment of the head gap adjusting apparatus 200, the shaft body 123 is disposed lower than the pivotal center of the bushing member 121, the pivotal center being indicated by center line $C_p$ in FIGS. 8 and 9. Accordingly, in order to raise the shaft body 123, i.e., in order to increase the head gap G, the pivot lever 141 is turned in the direction of the arrow A2 by a predetermined angle, the predetermined angle corresponding to an optimum head gap G for optimum printing on the printing medium P. Further, the pivot lever 141 is elastically biased in the direction of the arrow B2, which is opposite to the direction of arrow A2, by a spring member or spring 150. One end of the spring 150 is connected to the pivot lever or pivot member 141, while the other end of spring 150 is connected to the main frame 110. The pivot lever or pivot member 141 is turned to the direction of the arrow B2 by an external force acting on the pivot lever or pivot member 141.

Continuing with reference to FIGS. 6 through 9, the movable member 143 includes a slant surface 143*a* of a predetermined sloping degree and a projection 143*b* corresponding to the slant surface 141*a* and the projection 141*b* of the pivot member 141. The slant surface 143*a* of the movable member 143 contacts with the projection 141*b* of the pivot member 141, while the projection 143*b* of the movable member 143 contacts with the slant surface 141*a* of the pivot member 141. Further, the projections 141*b* and 143*b* prevent separation of the movable member 143 and the pivot member 141 when the movable member 143 is moved in the direction indicated by the arrow X1 of FIG. 8. Further, the movable member 143 includes a guide protrusion 143*c* guided along a guide hole, aperture or channel 115 formed in the main frame 110. The movable member 143 is moved between a position indicated by the letter C, that is a locking position of the movable member 143, as illustrated in FIG. 9, and a position indicated by the letter D, that is a releasing or resting position, or an initial position, of the movable member 143, as illustrated in FIG. 8. More specifically, when the movable member 143 is moved in the direction of the arrow X1, the movable member 143 is moved to the locking position where the movable member 143 pivots the pivot lever or pivot member 141 in the direction indicated by the arrow A2, and restricts the pivotal movement of the pivot member 141. Further, when the movable member 143 is moved in the direction of the arrow X2, the pivot member 143 can be pivoted in the direction of the arrow B2 to the initial or resting position.

The operation of the head gap adjusting apparatus 200 of an inkjet printer constructed as above according to an another, second preferred embodiment of the present invention of FIGS. 6 through 9 will now be described.

First, referring to FIG. 8, FIG. 8 illustrates the print head 133*a* at the lowest position, for example. The head gap G in such a state is proper, for example, for printing on the printing medium P such as an A4 sheet according to predetermined data for the printing medium P, such predetermined data being stored in a memory 149*a* for controller 149 or provided to controller 149. Meanwhile, referring to FIG. 9, in order to print on the printing medium P, such as an envelope that is thicker than the A4 sheet, for example, the controller 149 (FIG. 7) drives the motor 147 according to the corresponding predetermined data for the printing medium P, such as predetermined data corresponding to an envelope as the printing medium P, such predetermined data being stored in the memory 149*a* for the controller 149 or provided to the controller 149, such as through an input key or selector of the ink jet printer or from a computer. More specifically, the motor 147 rotates the pinion gear 146 clockwise as indicated by the direction of the arrow L1 as shown in FIG. 8. Then, by the relative movement of the rack gear 145 and the pinion gear 146, the movable member 143 is moved in the direction of the arrow X1. When the movable member 143 is moved to the position indicated by the letter C (FIG. 9), that is to the locking position, the pivot lever 141 is pushed by the movable member 143 and pivoted in the direction of the arrow A2 by a predetermined angle corresponding to the predetermined data for the printing medium P, and secured at the position indicated by the letter C. Accordingly, the shaft body 123, which is eccentric with respect to each bushing member 121, is raised by a predetermined distance, also corresponding to the predetermined data for the printing medium P, thereby raising the head assembly 130 disposed on the shaft body 123.

As a result, the head 133*a* is raised from the initial position by a proper distance, such as the distance corresponding to the thickness difference between the envelope and A4 sheet, for example. Accordingly, the appropriate head gap G can be maintained as illustrated in FIG. 8 or FIG. 9, for example, and the printing can be optimally performed even on a thick printing medium P.

Meanwhile, when the motor 147 is driven by the controller 149 in an opposite direction to the above-described clockwise direction, the pinion gear 146 is rotated in a counterclockwise direction as indicated by the direction of the arrow L2 in FIG. 9, accordingly moving the movable member 143 in the direction indicated by the arrow X2. When the movable member 143 is at the position indicated by the letter D (FIG. 8), that is at the releasing position of the movable member 143, the pivot lever 141 is pivoted by the recovering force of the spring 150 in the direction of the arrow B2 and to the original, initial or resting position of the pivot lever or pivot member 141. Accordingly, the print head 133*a* is returned to the initial position, and the head gap G is adjusted appropriately for a corresponding printing medium P, such as for printing on an A4 sheet as the printing medium P, for example.

Also, dependent upon the thickness of the printing medium P, the controller 149 can drive the motor 147 according to corresponding predetermined data for the printing medium P to adjust the head gap G for optimum printing on the printing medium P. In adjusting the head gap G for the printing medium P, the relative movement of the rack gear 145 and the pinion gear 146 and the movable member 143 can be moved in either the direction of the arrow X1 of FIG. 8 or in the direction of the arrow X2 of FIG. 9 to position the movable member 143 at a position between the locking position of the movable member 143, the position indicated by the letter C (FIG. 9), and the releasing or resting position for the movable member 143, the position indicated by the letter D (FIG. 8), with the pivot lever 141 being pivoted to an appropriate position between that indicated by the letter C and that indicated by the letter D. Accordingly, the printing head 133*a* is positioned at an appropriate position so as to provide a head gap G adjusted appropriately for a corresponding printing medium P.

Further, as shown in FIG. 7, the head assembly 130 can additionally include a head gap detecting sensor 160, such as light emitting and receiving sensor. In this case, as described earlier with reference to FIG. 3, the head gap detecting sensor 160 detects the length or distance of the head gap G. Further, based on the detected data by the head gap detecting sensor 160, the controller 149 controls the driving of the motor 147 to appropriately adjust the head gap G between the printing medium P and the print head 133*a*. Accordingly, the head gap G is adjusted according to the respective types of the printing medium P.

Similar to the operation of the head gap detecting sensor 40, the head gap detecting sensor 160 emits light to the printing medium P, receives reflected light from the printing medium P and detects the length or distance of the head gap G. The detected data corresponding to the head gap G is sent to the controller 149. The controller 149 compares the received detected data with a predetermined reference value, such as stored in memory 149*a* or provided to the controller 149, such as through an input key or select or of the ink jet printer or from a computer, corresponding to a head gap G for optimum printing on the printing medium P. Accordingly, the controller 149 sends a signal to the motor 147 causing the motor 147 to rotate in a corresponding predetermined direction a corresponding predetermined number of times so as to move the head assembly 130, including the print head 133*a*, in an appropriate corresponding direction such as either in the direction indicated by the arrow X1 or in the direction indicated by the arrow X2 by turning of the pinion gear 146 in an appropriate direction such as in the direction of the arrow L1 or in the direction of the arrow L2. Accordingly, the head gap G between the print head 133*a* and the printing medium P is adjusted appropriately according to the thickness of the printing medium P as previously described, by using the data detected by the head gap detecting sensor 160. The controller 149 automatically adjusts the head gap G, so that, regardless of the type of printing medium P, the controller 149 can maintain a desired length or distance of the head gap G.

Further, when the controller 149 compares data corresponding to the head gap G detected by the head gap detecting sensor 160 to a predetermined reference value corresponding to a head gap G for optimum printing on the printing medium P, and the detected data corresponds to such predetermined referenced value, no adjustment or no further adjustment of the head gap G is made by the controller 149. In such case, as previously described with respect to the head gap adjusting apparatus 100, the detected data corresponding to the head gap G indicates that the distance of the head gap G detected already corresponds to the head gap G for optimum printing on the printing medium P.

As described above, the head gap adjusting apparatus of the inkjet printer according to the present invention, such as the above described head gap adjusting apparatus 100 and 200, can detect and, thus, automatically adjust the head gap G for a corresponding printing medium P. Accordingly, the ink jet printer including a head gap adjusting apparatus of the present invention advantageously provides an enhanced compatibility, easier use, and a non-deteriorated print quality when using various types of printing medium.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. An inkjet printer head gap adjusting apparatus, comprising:

a main frame;

an eccentric shaft including a bushing member at each end of the eccentric shaft, the eccentric shaft being rotatably disposed on the main frame by each bushing member;

a head assembly movably disposed on the eccentric shaft, the head assembly including a print head that prints ink onto a printing medium;

a head gap detecting sensor that detects a size of a head gap between the printing medium and the print head, said head gap detecting sensor attached to said print head, said sensor directly measuring a size of said sensor emitting light that is reflected off the printing medium, said head gap sensor receiving said light reflected off said printing medium and determines the size of the head gap based on said light received by said sensor reflected off said printing medium;

an eccentric shaft turner that adjusts the size of the head gap by selectively turning the eccentric shaft to move the eccentric shaft through a predetermined angle to move the head assembly to provide a predetermined head gap between the printing medium and the print head; and a controller selectively controlling the driving of the eccentric shaft so as to move the eccentric shaft through the predetermined angle to change the size of the head gap detected by the head gap detecting sensor to provide the predetermined head gap, when the size of the head gap detected by the head gap detecting sensor is other than the predetermined head gap.

2. The apparatus of claim 1, further comprised of the eccentric shaft comprising:

a gear disposed on the bushing member at one end of the eccentric shaft; and a motor connected to the gear, the motor being driven under the control of the controller rotating the gear in a predetermined direction by a predetermined angle to provide the predetermined head gap between the printing medium and the print head.

3. The apparatus of claim 2, the head gap detecting sensor not being in contact with said printing medium, said head gap sensor directly measuring the size of said gap.

4. An inkjet printer head gap adjusting apparatus, comprising:

a main frame;

a head assembly including a print head;

an eccentric shaft movably supporting the head assembly, the eccentric shaft including a bushing member at each end of the eccentric shaft, each bushing member being rotatably supported on the main frame; and an eccentric shaft turner that adjusts the head gap between the print head and a printing medium by selectively turning the eccentric shaft forward in a first direction and backward in a second direction opposite to the first direction by a predetermined angle to move the head assembly to provide a predetermined head gap between the print head and the printing medium, the eccentric shaft turner comprising:

a pivot member disposed on at least one bushing member that pivots and rotates the bushing member;

a movable member movably disposed with respect to the main frame reciprocating the movable member, thereby providing the pivotal movement of the pivot member;

a driver providing the reciprocating movement of the movable member; and a controller selectively driving the driver to selectively drive the reciprocating movement of the movable member to selectively adjust the head gap between the print head and the printing medium to provide the predetermined head gap, when the head gap is other than the predetermined head gap, said apparatus further comprised of the movable member and the pivot member each including a slant surface of a predetermined sloping degree, the slant surface of the movable member being disposed in opposing relation to the slant surface of the pivot member, and with the slant surface of the movable member and the slant surface of the pivot member each respectively moving in an opposite directions during pivotal movement of the pivot member.

5. The apparatus of claim 4, further comprised of the movable member and the pivot member each including a projection respectively formed on the slant surface of the movable member and on the slant surface of the pivot member limiting a range of movement of the movable member and the pivot member and preventing the movable member from being separated from contact with the pivot member.

6. The apparatus of claim 5, further comprised of the driver comprising:

a rack gear formed on a side of the movable member;

a pinion gear rotatably formed with respect to the main frame meshed with the rack gear; and a motor driving the pinion gear to provide the reciprocating movement of the movable member.

7. An inkjet printer head gap adjusting apparatus, comprising:

a main frame;

a head assembly including a print head;

an eccentric shaft movably supporting the head assembly, the eccentric shaft including a bushing member at each end of the eccentric shaft, each bushing member being rotatably supported on the main frame; and an eccentric shaft turner that adjusts the head gap between the print head and a printing medium by selectively turning the eccentric shaft forward in a first direction and backward in a second direction opposite to the first direction by a predetermined angle to move the head assembly to provide a predetermined head gap between the print head and the printing medium, the eccentric shaft turner comprising:

a pivot member disposed on at least one bushing member that pivots and rotates the bushing member;

a movable member movably disposed with respect to the main frame reciprocating the movable member, thereby providing the pivotal movement of the pivot member;

a driver providing the reciprocating movement of the movable member; and a controller selectively driving the driver to selectively drive the reciprocating movement of the movable member to selectively adjust the head gap between the print head and the printing medium to provide the predetermined head gap, when the head gap is other than the predetermined head gap, the apparatus further comprised of the driver comprising:

a rack gear formed on a side of the movable member;

a pinion gear rotatably formed with respect to the main frame meshed with the rack gear; and a motor driving the pinion gear to provide the reciprocating movement of the movable member.

8. An inkjet printer head gap adjusting apparatus, comprising:

a main frame;

a head assembly including a print head;

an eccentric shaft movably supporting the head assembly, the eccentric shaft including a bushing member at each end of the eccentric shaft, each bushing member being rotatably supported on the main frame; and an eccentric shaft turner that adjusts the head gap between the print head and a printing medium by selectively turning the eccentric shaft forward in a first direction and backward in a second direction opposite to the first direction by a predetermined angle to move the head assembly to provide a predetermined head gap between the print head and the printing medium, the eccentric shaft turner comprising:

a pivot member disposed on at least one bushing member that pivots and rotates the bushing member;

a movable member movably disposed with respect to the main frame reciprocating the movable member, thereby providing the pivotal movement of the pivot member;

a driver providing the reciprocating movement of the movable member; and a controller selectively driving the driver to selectively drive the reciprocating movement of the movable member to selectively adjust the head gap between the print head and the printing medium to provide the predetermined head gap, when the head gap is other than the predetermined head gap, the apparatus further comprising a head gap detecting sensor disposed on the head assembly detecting data corresponding to the head gap between the print head and the printing medium, and providing the detected data to the controller so that the controller can selectively control the driving of the driver based on the detected data to provide the predetermined head gap between the print head and the printing medium, when the head gap detected by the head gap detecting sensor is other than the predetermined head gap.

9. The apparatus of claim 8, further comprised of the head gap detecting sensor including a light emitting and light receiving sensor.

10. An inkjet printer head gap adjusting apparatus, comprising:

an eccentric shaft;

a head assembly movably disposed on the eccentric shaft, the head assembly including a print head that prints ink onto a printing medium;

a head gap detecting sensor that detects a size of a head gap between the printing medium and the print head, the sensor being attached to said head assembly, said sensor emitting light towards said printing medium, said emitted light being reflected off said printing medium, said sensor detecting said reflected light and determining the size of said gap based on said reflected light; and an eccentric shaft turner that adjusts the size of the head gap by selectively turning the eccentric shaft to move the eccentric shaft through a predetermined angle to move the head assembly to provide a predetermined head gap between the printing medium and the print head.

11. The apparatus of claim 10, further comprising a controller for selectively controlling driving of the eccentric shaft turning means so as to move the eccentric shaft through the predetermined angle to correct the size of the head gap detected by the head gap detecting sensor to provide the predetermined head gap, when the size of the head gap detected by the head gap detecting sensor is other than the predetermined head gap.

12. The apparatus of claim 11, further comprised of the eccentric shaft turning means comprising:

a gear disposed on the eccentric shaft; and a motor connected to the gear, the motor for being driven under the control of the controller for rotating the gear in a predetermined direction by a predetermined angle to provide the predetermined head gap between the printing medium and the print head.

13. An inkjet printer head gap adjusting apparatus, comprising:

a head assembly including a print head;

an eccentric shaft movably supporting the head assembly, the eccentric shaft including a bushing member at each end of the eccentric shaft; and a turner adjusting a head gap between the print head and a printing medium by selectively turning the eccentric shaft forward in a first direction and backward in a second direction opposite to the first direction by a predetermined angle to move the head assembly to provide a predetermined head gap between the print head and the printing medium, the turner comprising:

a pivot member disposed on at least one bushing member that pivots and rotates the bushing member; and a movable member movably disposed with respect to the main frame reciprocating the movable member, thereby providing the pivotal movement of the pivot member;

further comprised of the movable member and the pivot member each including a slant surface of a predetermined sloping degree, the slant surface of the movable member being disposed in opposing relation to the slant surface of the pivot member, and with the slant surface of the movable member and the slant surface of the pivot member each respectively moving in an opposite direction during pivotal movement of the pivot member.

14. An inkjet printer head gap adjusting method, comprising the steps of:

detecting a size of a head gap between a printing medium and a print head, said head gap being detected by emitting light from a sensor mounted on a head assembly, said emitted light being directed towards said printing medium, said light being reflected off said printing medium, said reflected light being detected by said sensor, wherein the size of said gap being based on said emitted light and on said detected reflected light; and adjusting the size of the head gap by selectively turning an eccentric shaft on which said head assembly including the print head is disposed so as to move the head assembly either towards or away from said printing medium to provide a predetermined head gap between the printing medium and the print head, when the size of the head gap detected is other than the predetermined head gap.

15. The method of claim 14, further comprised of the head gap detecting sensor including a light emitting and light receiving sensor detecting the head gap.

16. The method of claim 14, further comprising the step of selectively controlling the adjusting of the size of the head gap by a controller so as to selectively turn the eccentric shaft to change the size of the head gap detected by the head gap detecting sensor to provide the predetermined head gap, when the size of the head gap detected by the head gap detecting sensor is other than the predetermined head gap.

17. An inkjet printer head gap adjusting method, comprising the steps of:

movably supporting a head assembly including a print head on an eccentric shaft; and adjusting a head gap between the print head and a printing medium by selectively turning the eccentric shaft in a predetermined direction by a predetermined angle to move the head assembly to provide a predetermined head gap between the print head and the printing medium by pivotally moving a pivot member disposed on the eccentric shaft by a reciprocating movement of a movable member by selectively driving the movable member to selectively adjust the head gap between the print head and the printing medium to provide the predetermined head gap, when the head gap is other than the predetermined head gap, further comprising the steps of:

detecting the size of the head gap between the print head and the printing medium to provide data corresponding to the size of the head gap between the print head and the printing medium said size of said head gap being determined by emitting light from a sensor disposed on the head assembly towards said printing medium and sensing light reflected off said printing medium by said sensor and determining the size of the gap based on said emitted light and on said detected reflected light; and controlling the selective turning of the eccentric shaft by selectively driving the movable member to selectively adjust the size of the head gap between the print head and the printing medium based on the detected data so as to provide the predetermined head gap between the print head and the printing medium, when the size of the head gap detected is other than the predetermined head gap.

18. The method of claim 17, further comprised of detecting the head gap between the print head and the printing medium by a head gap detecting sensor.

* * * * *